United States Patent [19]

Horikawa

[11] 4,109,608

[45] Aug. 29, 1978

[54] SOUND PRODUCING DEVICE

[76] Inventor: Shigeo Horikawa, No. 1-15-3, Taihei, Sumida-ku, Tokyo, Japan

[21] Appl. No.: 807,677

[22] Filed: Jun. 17, 1977

[30] Foreign Application Priority Data

Mar. 22, 1977 [JP] Japan ..... 52-31380

[51] Int. Cl.[2] ..... A63H 5/04; G10K 10/10

[52] U.S. Cl. ..... 116/137 R; 46/195

[58] Field of Search ..... 116/67 R, 137 R; 46/194, 195, 174, 195 R

[56] References Cited

U.S. PATENT DOCUMENTS

| | | | |
|---|---|---|---|
| 1,576,749 | 3/1926 | King | 46/194 |
| 1,771,340 | 7/1930 | Martin | 73/144 |
| 2,168,454 | 8/1939 | Smith | 46/195 X |
| 2,197,075 | 4/1940 | Fitzgerald | 91/377 X |
| 3,591,978 | 7/1971 | Bollman | 46/175 R |
| 3,774,572 | 11/1973 | Borraccio | 116/67 R |

FOREIGN PATENT DOCUMENTS

| | | | |
|---|---|---|---|
| 663,322 | 12/1951 | United Kingdom | 46/195 |
| 658,217 | 10/1951 | United Kingdom | 46/195 |

*Primary Examiner*—Daniel M. Yasich

[57] ABSTRACT

A sound producing device which can produce a loud sound is disclosed. The device includes a moveable frame and a flexible and hermetically sealed cylindrical bag enclosed in such moveable frame as well as a bellows extensible and compressible in the axial direction of the frame. The bellows is intermittently driven so as to compress air contained therein and to release it. The compressed air is abruptly released to break a sheet of paper and produce the loud sound.

10 Claims, 9 Drawing Figures

SOUND PRODUCING DEVICE

BACKGROUND OF THE INVENTION

This invention relates to a sound producing device which can produce a sound similar to a sound emitted from a fire arm or any other operating sounds and can exhibit an imitation sound effect.

Such kind of device has heretofore used a piston-shaped cylinder mechanism. The cylinder is solid and compressed air energy produced therein is used to instantaneously break a sheet of paper and hence produce the sound emitted from the fire arm. As a result, in order to increase a pushing force of a piston rod, a spring having a strong abrupt elastic energy has been used after taking into consideration the mechanical loss due to the maintenance of the desired air tightness between piston and the cylinder. In addition, a large driving force is required for the purpose of compressing the spring. The device, however, limited in space, so that not only the cylinder mechanism but also a valve, crank mechanism etc. which is composed of a number of parts could not be incorporated into the device. In addition, the device msut be less expensive. If such device is required to be fabricated in a precise manner which is greater than a tolerable precision and requires assembly in increased steps, the device becomes heavy in weight and expensive to manufacture. The conventional sound producing device could not eliminate the above mentioned disadvantages.

SUMMARY OF THE INVENTION

An object of the invention, therfore, is to provide a sound producing device which can eliminate the above mentioned disadvantages which have been encountered with the conventional techniques.

A feature of the invention is the provision of a sound producing device comprising a frame, a flexible and hermetically sealed cylindrical bag enclosed in said frame and including a bellows extensible and compressible in the axial direction of said frame, said cylindrical bag having an opening at its one end, a feed mechanism enclosed in said frame and for feeding a sheet for hermetically closing said opening of said cylindrical bag, a pressure adhering mechanism enclosed in said frame and for adhering said sheet to the peripheral edge of said opening under pressure, a pushing mechanism enclosed in said frame and for abruptly and resiliently pushing the closed end of said cylindrical bag toward said opening, and a driving mechanism enclosed in said frame and for interlocking said feeding mechanism with both said pressure adhering mechanism and said pushing mechanism so as to operate all of these mechanisms in an intermittent manner.

In accordance with the invention, use is made of a flexible and hermetically sealed cylindrical bag including a bellows and containing air. This cylindrical bag is directly subjected to an elastic and abrupt pushing and compressive force. As a result, it is possible to obtain a compressive air energy which is sufficient to most efficiently break a sheet of paper with least possible displacement of a pushing rod and to thereby produce a sound similar to that emitted from a fire arm. The sound producing device according to the invention can be repeatedly used, is compact in construction, can maintain a significantly high air tightness, is excellent in precision and reliable in operation, and can be manufactured in a less expensive manner.

BRIEF DESCRIPTION OF DRAWINGS

The invention will now be described in greater detail with reference to the accompanying drawings, wherein.

PREFERRED EMBODIMENT OF THE INVENTION

Figure 1:
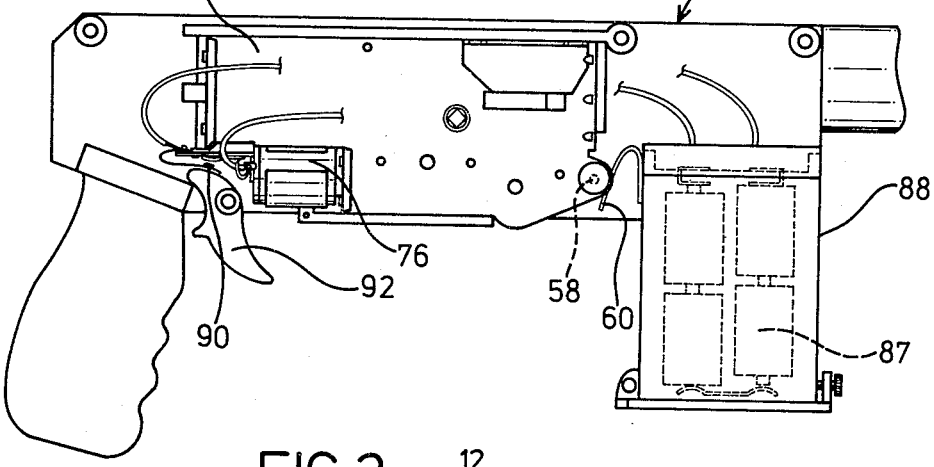
FIG. 1 is a front elevational view of one embodiment of a sound producing device according to the invention, parts being removed.
Figure 2:
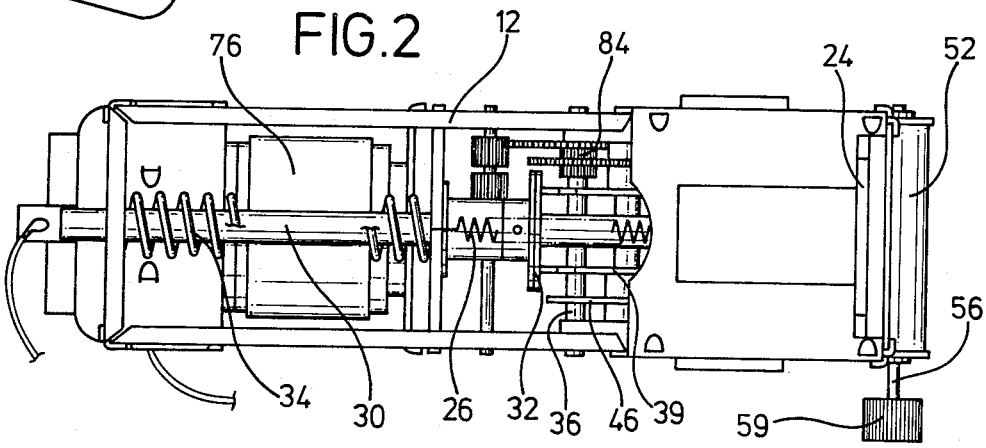
FIG. 2 is a top plan view of the main parts of the sound producing device shown in FIG. 1.
Figure 3:
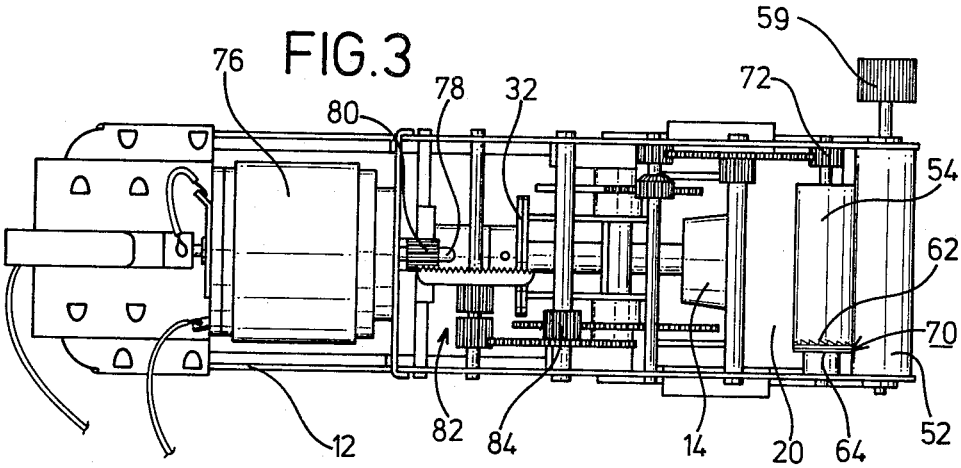
FIG. 3 is a bottom plan view of the device shown in FIGS. 1 and 2.
Figure 4:
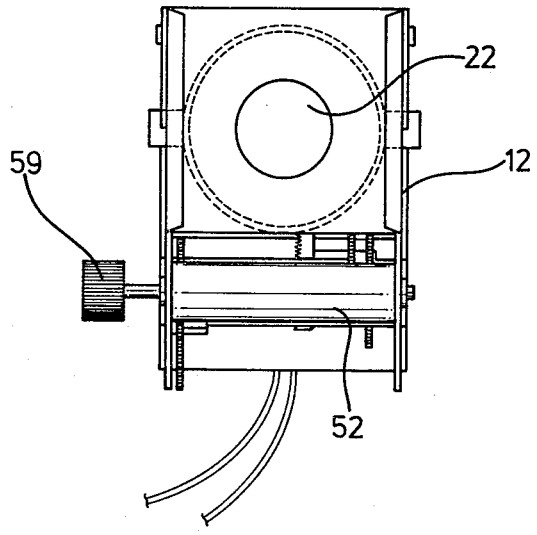
FIG. 4 is an end view of the device shown in FIG. 2.
Figure 5A:
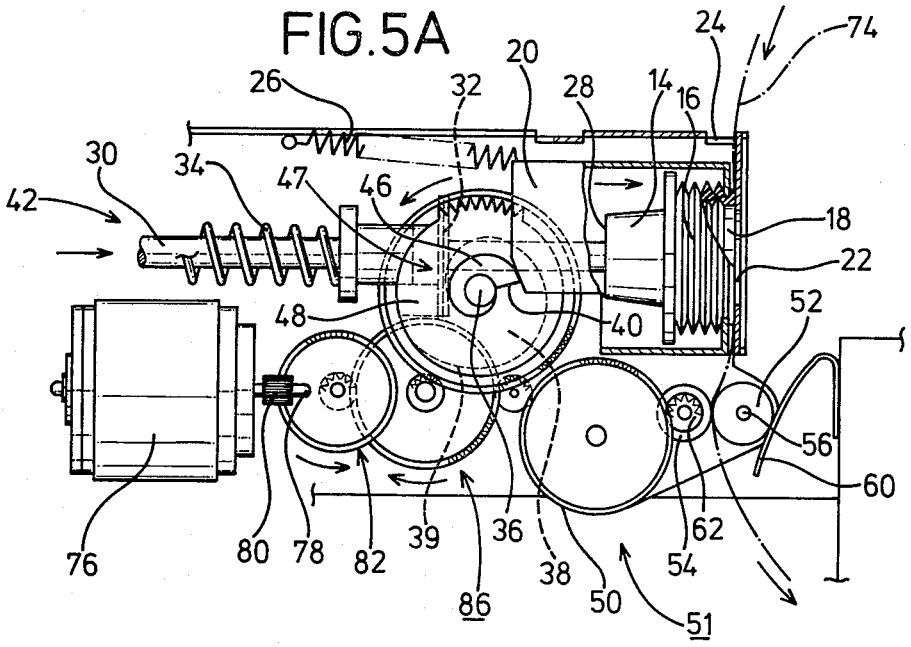
FIG. 5A is a front elevational view of the main parts of the sound producing device shown in FIG. 1, showing an operating condition in which a cylindrical bag is collapsed and a sheet is broken.
Figure 5B:
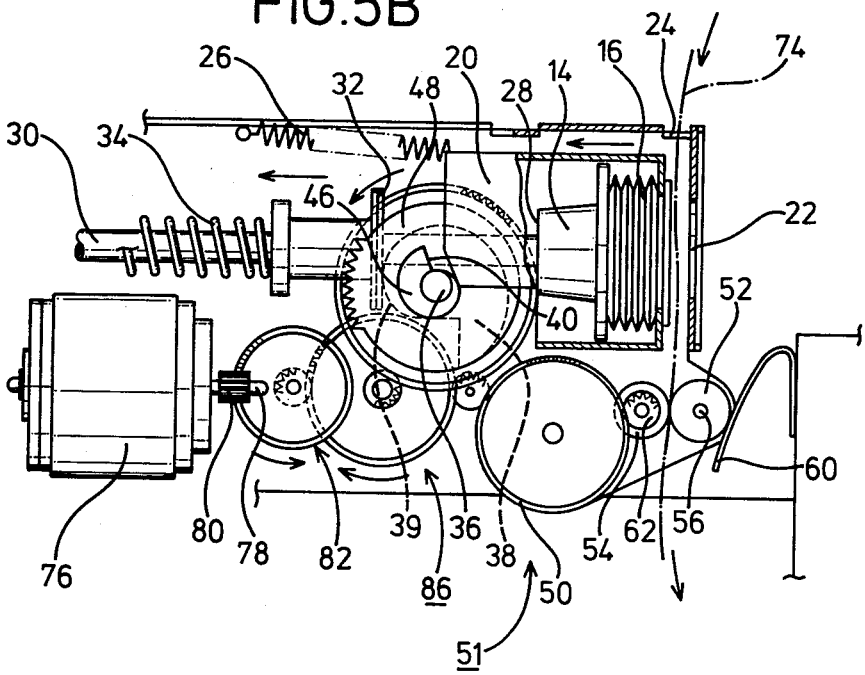
FIG. 5B is a view similar to FIG. 5A, but showing another operation condition in which a cylindrical frame is moved backwardly to release the sheet.
Figure 5C:
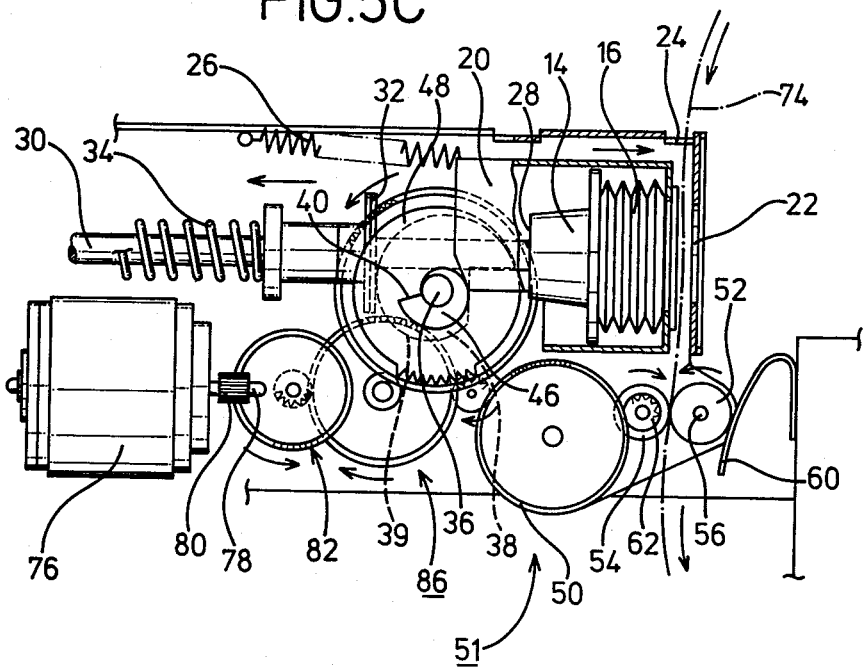
FIG. 5C is a view similar to FIG. 5A, but showing a further operating condition in which the sheet is fed.
Figure 5D:
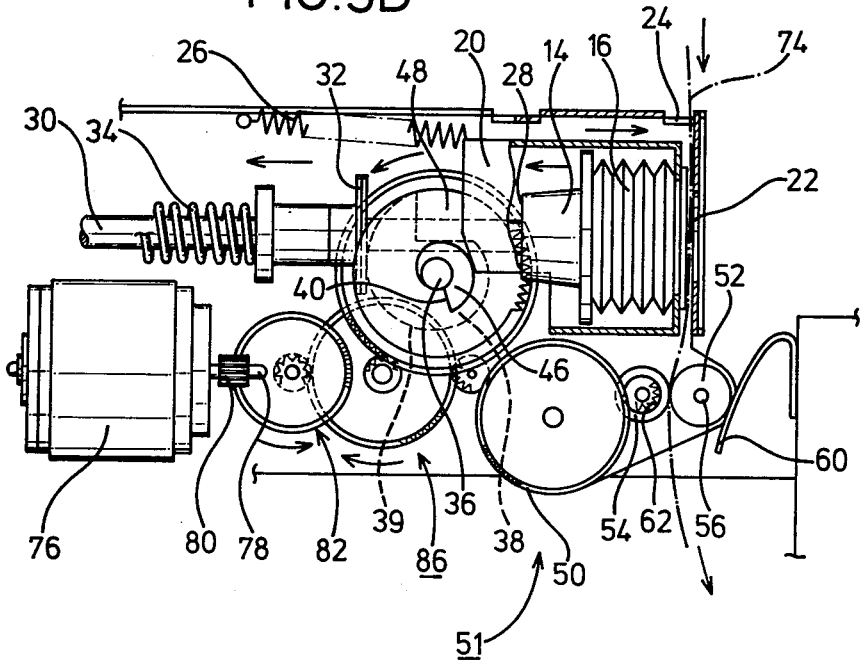
FIG. 5D is a view similar to FIG. 5A, but showing a still further operation condition in which the cylindrical bag becomes extended.
Figure 5E:
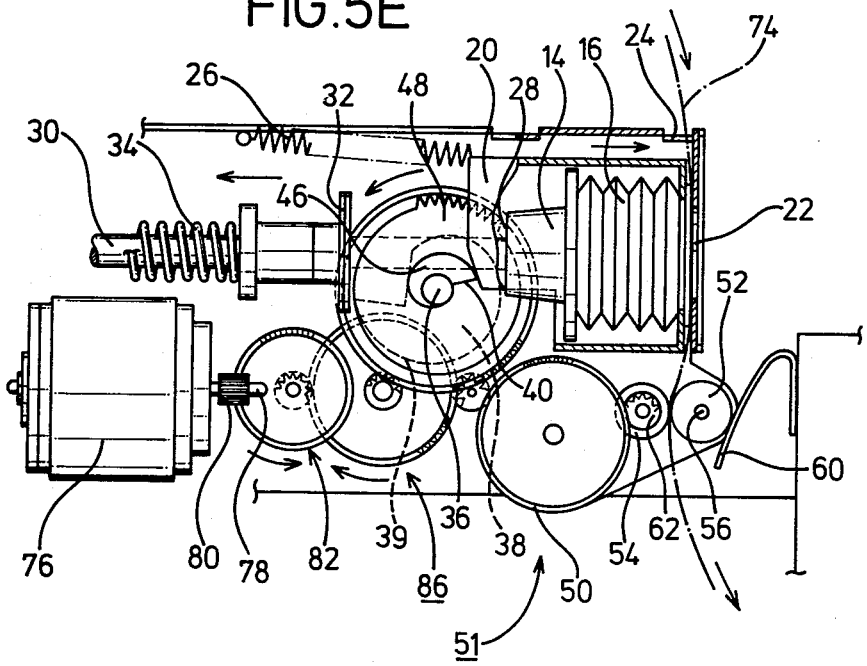
FIG. 5E is a view similar to FIG. 5A, but showing another operating condition which is immediately before a condition in which the cylindrical frame is urged against its sheet and the cylindrical bag is compressed.

Referring to the drawings, the reference numeral 10 designates one embodiment of a sound producing device according to the invention. In this embodiment, the sound producing device according to the invention is applied to a simulated fire arm such as a machine gun. The invention may also be applied to various kinds of toys, such as, a vehicle, robot, airplane, alarm, signal, etc.

The device 10 comprises a rectangular frame 12 which encloses therein a cylindrical bag 14 including a bellows 16 which is extensible and compressible in the axial direction of the frame 12. The cylindrical bag 14 is formed of a flexible plastic and is hermetically sealed. The cylindrical bag 4 is provided at its one end with an opening 18 and is reduced in diameter near the peripheral edge of the opening 18. The frame 12 also encloses therein a cylindrical frame 20 which is provided at its closed end wall with a circular hole.

The frame 12 is provided at its one end wall with an opening 22 and at its upper wall with slit 24. In the frame 12 is enclosed the cylindrical frame 20 with its circular hole opposed to the opening 22 of the frame 12. In the cylindrical frame 20 is enclosed the cylindrical bag 14 with its reduced diameter portion engaged with the circular hole of the cylindrical frame 20. The inner end of the cylindrical frame 20 is connected through a coil spring 26 to the upper or lower part of the frame 12 at an intermediate portion. The coil spring 26 may be wound around a suitable rod or extended through a suitable groove and is adapted to resiliently move the cylindrical frame 20 toward the intermediate portion of the frame 12.

To the closed end 28 of the cylindrical bag 14 is connected one end of a push rod 30 which is provided at its substantially intermediate portion with a flange 32. The push rod 30 extends in the lengthwise direction of the frame 12 and extends through a guide hole provided in the other end wall of the frame 12 remote from bag 14. Between a flange provided on the push rod 30 and the other end of the frame 12 is inserted a coil spring 34 which is wound around the push rod 30. An operating shaft 36 is journalled in the two side walls of the frame 12 and extends between the flange 32 and the closed end 28 of the cylindrical bag 14 in a direction perpendicular to the push rod 30. The operating rod 36 is located below rod 30 and is provided with a pair of plate-shaped cams 38 each having a spirally formed side edge 39 and a notched edge 40 whose surface extends in a direction perpendicular to its side edge 39. The cams 38 are located at both sides of the push rod 30 such that the spirally formed side edge 39 makes contact with the inside surface of the flange 32 and that the notched edge 40 becomes parallel with the push rod 30 when the spirally formed side edge 39 is rotated substantially 360°, thereby providing a pushing mechanism 42.

The operating shaft 36 provided with the spirally formed plate-shaped cam 38 is also provided with a small plate-shaped cam 46 which is substantially similar in shape to the plate-shaped cam 38. The small plate-shaped cam 46 is secured to the operating shaft 36 such that both notched edges 40, 40 of the plate-shaped cams 38, 46 are substantially diametrically opposed to each other with respect to the operating shaft 36. The spirally formed side edge of the small plate-shaped cam 46 is adapted to push the inside end of the cylindrical frame 20 thereby providing a pressure applying mechanism 47. To the operating shaft 36 is also secured a partial segment gear wheel 48 adapted to be threadedly engaged with an interlocking gear mechanism 50 provided at the lower part of one end of the frame 12 when the plate-shaped cam 46 is disengaged from the inside end of the cylindrical frame 20.

At the lower part of one end of the frame 12 are arranged a pair of plastic rollers 52, 54 which make contact with each other. The outside roller 52 is secured to a shaft 56 which projects out of the frame 12 through a hole 58 having a diameter slightly larger than that of the shaft 56. To the outer end of the shaft 56 is secured a knob 59. The roller 52 is formed of a hard plastic and urged against the inside roller 54 by means of a lead spring 60. The inside roller 54 is composed of a cylindrical rubber roller which is provided at its one end with threads 62 and is loosely mounted on a shaft. To this shaft is secured a disc 64 having threads 62 adapted to be engaged with the corresponding threads 62 of the cylindrical rubber roller 54 thereby providing a ratchet mechanism 70 which is rotatable in a given direction only. To the other end of this shaft is secured a gear wheel 72 which is threadly connected to the above mentioned interlocking gear mechanism 50 thus providing a feed mechanism 51 for feeding a band-shaped sheet 74.

The frame 12 is provided at its other lower end with a motor 76 having an output shaft 78 projected from the motor 76 toward the one end of the frame 12. To the output shaft 78 is secured a transmission gear 80 which is threadly connected through a reduction gear mechanism 82 to a gear 84 secured to the operating shaft 36, thereby providing a driving mechanism 86.

The frame 12 for enclosing the mechanisms 42, 47, 51 and 86 therein is incorporated into the device 10 which in the present embodiment, is shown as a toy machine gun. A battery 87 is enclosed in that portion of the device 10 which is intended to comprise the shell magazine 88. An electric circuit is composed of the motor 76 and the battery 87 and is opened and closed by means of a switch 90 with the aid of a trigger 92.

The above described embodiment of the invention will operate as follows.

At first, a band-shaped sheet such as a band-shaped paper 74 is inserted through the slit 24 of the frame 12 between the rollers 52, 54 of the feed mechanism 51. Then, the knob 59 is rotated to rotate the roller 52 so as to grip the lower end of the sheet 74 covering the opening 18 of the cylindrical bag 14 between the rollers 52, 54. The trigger 92 is then pulled, causing the switch 90 to close the electric circuit thereby energizing the motor 76 and rotating it. The rotation of the motor 76 is transmitted through the output shaft 78 and reduction gear mechanism 82 to the operating shaft 36 so as to rotate it at a reduced speed. At the same time, the spirally formed side edge 39 of the spirally formed plate-shaped cam 38 is urged against the flange 32 to push the push rod 30 inwardly against the action of the coil spring 34.

The push rod 30 is displaced inwardly as the spirally formed side edge 39 is rotated. The displacement becomes maximum immediately before the notched edge 40 makes contact with the flange 32. At this instant, that side edge of the small plate-shaped cam 46 which is the longest in radius causes the cylindrical frame 20 to displace outwardly against the action of the coil spring 26 so as to urge the peripheral edge of the opening 18 of the cylindrical bag 14 against the peripheral edge of the opening 22 formed at the outside end of the frame 12 with the sheet 74 sandwiched therebetween. As a result, the sheet 74 functions to hermetically close the opening 18 of the cylindrical bag 14.

A further rotation of the plate-shaped cam 38 causes its notched edge 40 to be disengaged from the flange 32, and as a result, the elastic energy accumulated in the coil spring 34 instantaneously is released to displace the push rod 30 outwardly along the notched edge 40 thus instantaneously collapsing the cylindrical bag 14 and compressing the air therein. The compressed air produced in the cylindrical bag 14 functions to break the sheet 74 which has hermetically closed the opening 18 and hence produce an instantaneously abrupt air pressure change thereby producing a loud sound.

Then, the spirally formed side edge 39 of the plate-shaped cam 38 causes the push rod 30 to displace backwardly against the action of the coil spring 34. At the same time, the small plate-shaped cam 46 is also rotated to separate the peripheral edge of the opening 18 from the hole 22 of the frame 12 by means of the coil spring 26. At the same time, the partial segment gear 48 becomes in mesh with the interlocking gear mechanism 50, and as a result, the gear 72 secured to the shaft of the roller 54 is rotated. The rotation of the gear 72 is transmitted through the ratchet mechanism 70 to the roller 54 which is then rotated to pull that portion of the sheet 74 which has no punctured hole into the frame 12. The above described operation is then repeated intermittently to produce the loud sound in an intermittent manner until a given length of the sheet 74 is exhausted.

The sound producing device constructed as above described according to the invention is capable of producing compressed air in the cylindrical bag 14 in an extremely short time by collapsing the cylindrical body 14 having the bellows 16 hermetically closed by the sheet 74 and by breaking the sheet 74 by the abrupt elastic energy accumulated in the cylindrical bag 14, and producing the instantaneous air pressure change and hence producing the loud sound.

The cylindrical bag 14 may be incorporated into a cavity, etc. in the device 10. In such case, the device 10 may be utilized as a sound resonator. In addition, the inner wall surface of the cavity may be formed of a material having a residual sound effect or sound absorbing effect. In this case, it is possible to produce a sound different in tone thereby producing an imitation sound which is extremely real and convincing persons to bear it. In addition, the cavity may incorporate therein a sound plate which is then oscillated to obtain the above mentioned effect. Particularly, a combination of the position of the cylindrical bag 14 relative to the device 10 and the configuration of the inner part of the device 10 makes it possible to amplify the sound. For example, to one end of a passage communicated with a cylinder designed to resemble a fire arm is opposed the opening 18 of the cylindrical bag 14. This arrangement renders it possible to amplify and resonate the sound and hence produce an extremely loud sound and provide an significantly interesting device 10.

A combination of the sound producing device according to the invention and a whistle can improve the sound tone to obtain various kinds of sounds. The bellows 16 causes the cylindrical bag 14 to freely become extensible and compressible, so that in the compression of the cylindrical bag 14, it is not always necessary to bring the pushing direction into strict alignment with the axial direction of the cylindrical bag 14. As a result, it is not always necessary to provide a precise cylinder which has been required in the conventional techniques. In addition, the sound producing device according to the invention can produce compressed air in a paritive manner and requires a small space and position for installation.

The pushing mechanism 42 may be formed of the spring 34 or a link mechanism or crank mechanism adapted to be displaced in an accelerative manner and to make the moving speed the highest near the dead point thereof thus producing the compressed air in a significantly efficient manner.

In addition, the diameter of the opening 18 of the cylindrical bag 14 may be made extremely large as in the case of a cannon and combined with a suitable resonance and amplification cylinder. In such a case, it is possible to produce a sound which is louder than the explosive sound of gunpowder and hence utilize the device so as to deliver a signal, etc. Alternatively, the intermittent operation of the device may be so controlled that a sound for frightening and expelling an injurious bird from a granary field can be produced.

As stated hereinbefore, the sound producing device according to the invention is extremely compact in construction, easy in installation, can efficiently compress the air by the least possible movement of the pushing rod, can easily produce a loud imitation sound and extremely is cheap in price.

What is claimed is:

1. A sound producing device comprising:

a frame having an opening at one end thereof;

a hermetically sealable cylindrical bag member including a bellows section that is extensible and compressible axially of said frame, said bag member being mounted on said frame for movement relative thereto and having at one end of the bag member an opening coaxial with the opening in said frame;

means for feeding and positioning a sheet of rupturable material between the openings in said frame and bag members for blocking the opening in said bag member;

a pushing and force developing assembly mounted within said frame including a push rod connected to said bag member and extending coaxially with the opening therein, spring means connected operatively between said frame and said push rod and first cam means adapted to urge said push rod against the bias of said spring means and to thereby extend the bellows section of said bag member and at the desired time to release said push rod for movement in the opposite direction under the influence of the force developed by said spring means and to thereby compress said bellows section;

a movable inner frame carried within said frame, said movable inner frame enclosing said bag member and connected thereto adjacent the opening in said bag member;

second cam means engageable with said movable inner frame and adapted to urge same and said bag member in a first direction such that said bag member is hermetically sealed by closing of the opening therein by said sheet of rupturable material, said first and second cam means being formed such that said push rod is not releasable by said first cam means until said second cam means has urged said movable inner frame to shift the bag member into hermetically sealed relationship with said sheet;

and drive means for driving said first and second cam means and said sheet feeding and positioning means.

2. A sound producing device according to claim 1, wherein said first and second cam means are mounted on a common shaft and each comprise cams having a spirally formed edge and a notched edge, the notches in said first and second cams being displaced relative to each other.

3. A sound producing device according to claim 2, including a flange on said push rod, the spiral edge of said first cam means being engageable with said flange.

4. A sound producing device according to claim 1, including additional spring means for normally biasing said inner movable frame inwardly of said frame and thereby said bag member out of engagement with the rupturable sheet.

5. A sound producing device according to claim 1, wherein said drive means includes electric motor means and a drive train operatively connected to said first and second cam means.

6. A sound producing device comprising:

a frame having an opening at one end thereof;

a hermetically sealable cylindrical bag member including a bellows section that is extensible and compressible axially of said frame, said bag member being mounted on said frame for movement relative thereto and having at one end of the bag member an opening coaxial with the opening in said frame;

a feed mechanism associated with said frame for feeding a sheet of rupturable material between the openings of said frame and bag member to hermetically seal same;

an inner cylindrical frame member movably mounted within said frame and operatively connected to said bag member;

means for urging said inner frame member and the bag member therewith so as to hermetically seal said bag member against the sheet material;

a pushing mechanism mounted within said frame adapted to develop a force for application to said bag member to resiliently urge same towards said one end of said frame to compress said bellows section and compress the air therewithin to a level at which air is forced against the sheet through said opening in the bag member to rupture the sheet and produce a desired sound said pushing mechanism including plate cam means having a spirally formed edge and a notched edge and a push rod connected to said bag member, said plate cam means being engageable with said push rod;

said inner frame member urging means being adapted to urge said inner frame member to hermetically seal said bag member prior to compression of said bellows section by said pushing mechanism;

and a driving mechanism operably connected with and adapted to drive said feed mechanism, said inner frame member urging means and said pushing mechanism in predetermined sequential relationship.

7. A sound producing device comprising:

a frame having an opening at one end thereof;

a hermetically sealable cylindrical bag member including a bellows section that is extensible and compressible axially of said frame, said bag member being mounted on said frame for movement relative thereto and having at one end of the bag member an opening coaxial with the opening in said frame;

a feed mechanism associated with said frame for feeding a sheet of rupturable material between the openings to hermetically seal same;

an inner cylindrical frame member movably mounted within said frame and operatively connected to said bag member;

means for urging said inner frame member and the bag member therewith so as to hermetically seal said bag member against the sheet material;

a pushing mechanism mounted within said frame including spring means, a push rod and means for urging said push rod against the bias of said spring means to develop a force for application to said bag member to resiliently urge same towards said one end of said frame to compress said bellows section and compress the air therewithin to a level at which air is forced against the sheet through the opening in the bag member to rupture the sheet and produce a desired sound;

said inner frame member urging means being adapted to urge said inner frame member to hermetically seal said bag member prior to compression of said bellows section by said pushing mechanism;

and a driving mechanism including motor means, a reducing gear train operatively connected to an output shaft of said motor means, a pair of rollers engageable with each other and mounted adjacent the end of the frame having said opening therein, one of said rollers carrying a knob at the outer end thereof, the other of said rollers being loosely mounted on a shaft therefor and provided with threads at one end thereof, said shaft having a disc secured thereto with threads thereon adapted to engage with the threads on said other roller so as to form a ratchet mechanism rotatable in one direction, said shaft being provided with a gear wheel, an operating shaft being provided for carrying said push rod urging means and said inner frame member urging means, said operating shaft also carrying a partial segment gear wheel threadedly engageable with the gear wheel on said roller carrying shaft, and said reducing gear train being operatively engaged with said operating shaft to drive same.

8. A sound producing device comprising:

a frame having an opening at one end thereof;

a hermetically sealable cylindrical bag member including a bellows section that is extensible and compressible axially of said frame, said bag member being mounted on said frame for movement relative thereto and having at one end of the bag member an opening coaxial with the opening in said frame;

a feed mechanism associated with said frame for feeding a sheet of rupturable material between the openings of said frame and bag member to hermetically seal same;

an inner cylindrical frame member movably mounted within said frame and operatively connected to said bag member;

plate cam means having a spirally formed edge and a notched edge engageable with said inner frame member;

a pushing mechanism mounted within said frame adapted to develop a force for application to said bag member to resiliently urge same towards said one end of said frame to compress said bellows section and compress said bellows section and compress the air therewithin to a level at which air is forced against the sheet through said opening in the bag member to rupture the sheet and produce a desired sound;

said plate cam means being adapted to urge the said inner frame member in the direction of said one end of said frame and the bag member therewith so as to hermetically seal said bag member against the sheet material prior to the compression of said bellows section by said pushing mechanism;

and a driving mechanism operably connected with and adapted to drive said feed mechanism, said plate cam means and said pushing mechanism in predetermined selected relationship.

9. A sound producing device according to claim 8, wherein said pushing mechanism includes a push rod connected to said inner frame member, an operating shaft mounted rotatably in said frame, and plate cam means having a spirally formed edge and a notched edge, said plate cam means being engageable with said push rod for urging same within said frame in a first direction for development of the bellows compressing force and release of said push rod for movement in a reverse direction to compress said bellows.

10. A sound producing device according to claim 9, said driving mechanism including motor means, a reducing gear train operatively connected to an output shaft of said motor means, a pair of rollers engageable with each other and mounted adjacent the end of the frame having said opening therein, one of said rollers carrying a knob at the outer end thereof, the other of said rollers being loosely mounted on a shaft therefor and provided with threads at one end thereof, said shaft having a disc secured thereto with threads thereon adapted to engage with the threads on said other roller so as to form a ratchet mechanism rotatable in one direction, said shaft being provided with a gear wheel, said operating shaft carrying the plate cam means for urging said inner frame member and said push rod, said operating shaft also carrying thereon a partial segment gear wheel threadedly engageable with the gear wheel on said roller carrying shaft, said reducing gear train being operatively engaged with said operating shaft to drive same.

* * * * *